US008303168B2

(12) United States Patent
Takasawa

(10) Patent No.: US 8,303,168 B2
(45) Date of Patent: Nov. 6, 2012

(54) DEVICE AND A METHOD OF MANUFACTURING A HOUSING MATERIAL

(75) Inventor: Koki Takasawa, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 877 days.

(21) Appl. No.: 12/208,524

(22) Filed: Sep. 11, 2008

(65) Prior Publication Data

US 2009/0073815 A1 Mar. 19, 2009

(30) Foreign Application Priority Data

Sep. 14, 2007 (JP) ..... 2007-239216

(51) Int. Cl.

| | |
|---|---|
| ***G04B 37/00*** | (2006.01) |
| ***A44C 5/00*** | (2006.01) |
| ***C23C 8/50*** | (2006.01) |
| ***C23C 8/00*** | (2006.01) |
| ***C22C 38/18*** | (2006.01) |

(52) U.S. Cl. ..... 368/280; 368/281; 368/293; 148/230; 148/232; 148/318; 420/34

(58) Field of Classification Search ..... 368/280, 368/281, 283, 286, 293, 276; 148/206, 210, 148/212, 225, 230, 232, 316–318; 419/13, 419/14; 420/13, 34, 65, 104, 128
See application file for complete search history.

(56) References Cited

U.S. PATENT DOCUMENTS

| | | | | |
|---|---|---|---|---|
| 3,804,678 | A * | 4/1974 | Kindlimann | 148/318 |
| 3,943,010 | A * | 3/1976 | Hartline, III | 148/317 |
| 4,154,629 | A * | 5/1979 | Asai et al. | 148/232 |
| 4,243,329 | A * | 1/1981 | Nakayama | 368/76 |
| 4,309,461 | A * | 1/1982 | Shibata | 427/259 |
| 4,897,825 | A * | 1/1990 | Ikenishi | 368/228 |
| 4,936,911 | A * | 6/1990 | Roberts et al. | 75/238 |
| 5,503,687 | A * | 4/1996 | Berns | 148/230 |
| 5,503,797 | A * | 4/1996 | Zoch et al. | 420/38 |
| 5,714,115 | A * | 2/1998 | Speidel et al. | 420/65 |
| 5,792,282 | A * | 8/1998 | Tahara et al. | 148/206 |
| 5,848,350 | A * | 12/1998 | Bulger | 419/36 |
| 5,873,956 | A * | 2/1999 | Tanaka et al. | 148/318 |
| 6,093,233 | A * | 7/2000 | Magnin | 75/244 |
| 6,413,328 | B2 * | 7/2002 | Takayama et al. | 148/319 |
| 6,641,640 | B1 * | 11/2003 | Hesse et al. | 75/236 |
| 6,679,954 | B1 * | 1/2004 | Takano et al. | 148/325 |
| 6,682,581 | B1 * | 1/2004 | Speidel | 75/252 |
| 6,682,582 | B1 * | 1/2004 | Speidel | 75/252 |
| 6,905,758 | B1 * | 6/2005 | Kushida et al. | 428/212 |
| 2004/0062151 | A1 * | 4/2004 | Miyama | 368/309 |
| 2006/0008669 | A1 * | 1/2006 | Chan | 428/627 |
| 2006/0130934 | A1 * | 6/2006 | Kuroda et al. | 148/221 |
| 2006/0130938 | A1 * | 6/2006 | Kramer | 148/325 |

(Continued)

FOREIGN PATENT DOCUMENTS

EP 1 489 472 A1 12/2004

(Continued)

*Primary Examiner* — Vit W Miska

(74) *Attorney, Agent, or Firm* — Global IP Counselors, LLP

(57) ABSTRACT

A device has a magnetically shielded component that is magnetically shielded from an external magnetic field, and a housing. The housing is made from a ferritic stainless steel that has an austenitized surface layer rendered on the surface, and an internal layer portion having an internal ferrite phase that functions as a magnetic shield for the magnetically shielded component.

6 Claims, 3 Drawing Sheets

U.S. PATENT DOCUMENTS

| | | | | |
|---|---|---|---|---|
| 2007/0186999 | A1 * | 8/2007 | Kuroda et al. | 148/217 |
| 2007/0217293 | A1 * | 9/2007 | Takasawa | 368/280 |

FOREIGN PATENT DOCUMENTS

| | | | |
|---|---|---|---|
| EP | 1 542 100 | A2 | 6/2005 |
| JP | 63-5294 | * | 1/1988 |
| JP | H09-031505 | A | 2/1997 |
| JP | 2001-140041 | A | 5/2001 |
| JP | 2004-068115 | A | 3/2004 |
| JP | 2006-316338 | A | 11/2006 |
| JP | 2007-247035 | A | 9/2007 |
| JP | 2007-248397 | A | 9/2007 |
| JP | 2007-248398 | A | 9/2007 |

* cited by examiner

DEVICE AND A METHOD OF MANUFACTURING A HOUSING MATERIAL

BACKGROUND

1. Field of Invention

The present invention relates to a device such as a timepiece that has a housing and a magnetically shielded component that is magnetically shielded from an external magnetic field, and to a method of manufacturing a housing material used as an external component of the device.

2. Description of Related Art

Stepping motors that have an electromagnet made from a drive coil and a stator, a rotor made from a permanent magnet, and use the repulsion of the electromagnet and rotor to drive the rotor are commonly used in timepiece movements to drive the hands in modern electronic timepieces. Such movements may cease operating normally when exposed to a strong external magnetic field. The movement is therefore covered with a dedicated magnetic shield. A structure with this dedicated magnetic shield according to the related art is shown in FIG. 2, but the structure is described in detail in contrast to a preferred embodiment of the invention below.

Components used in the case member of a timepiece must meet certain standards in terms of hardness, corrosion resistance, appearance, and other surface properties. The case member components of a timepiece must also be easily manufactured or processed to the desired shape and size in order to achieve the desired timepiece design or size.

Japanese Unexamined Patent Appl. Pub. JP-A-H09-31505 teaches a method of manufacturing a timepiece case member by mixing and kneading an organic binder with an alloy powder of ferritic stainless steel, extrusion molding, degreasing, and then sintering the component. The timepiece case member components resulting from this manufacturing method can be used as a magnetic shield, and are easily worked.

However, because a ferritic material is used, the resulting components do not offer the hardness, corrosion resistance, appearance, and other surface properties that are most important in a timepiece case member. More specifically, this material is not practical for use as a case member.

Austenitic stainless steel, however, offers excellent surface properties including strength and corrosion resistance, and is therefore used in case members to take advantage of these properties. However, because austenitic stainless steel is difficult to process, processing austenitic stainless steel to the desired shape is difficult and manufacturing costs therefore rise.

Japanese Unexamined Patent Appl. Pub. JP-A-2004-68115 and Japanese Unexamined Patent Appl. Pub. JP-A-2006-316338 therefore teach methods of first using easily processed ferritic stainless steel to produce case member components with the desired shape, and then austenitize the surface using nitrogen to achieve the strength, corrosion resistance, and other surface properties desired in a case member.

However, these methods simply teach technology for using ferritic stainless steel to produce case member parts of the desired shape from ferritic stainless steel, and then austenitize the surface using nitrogen gas in order to achieve the strength, corrosion resistance, and other surface properties desired in a case member, and are silent regarding the internal structure of the ferrite phase after the austenitizing process.

The austenitizing process using nitrogen gas enables the nitrogen atoms to penetrate the ferrite phase from both front and back sides of the work piece, and the portion in which the nitrogen concentration rises to at least a predetermined level changes to the austenite phase. The rate at which the nitrogen penetrates the ferrite phase is not uniform and varies according to the location. As a result, the nitrogen concentration is also not uniform, and the interface between the austenitized parts of the surface layer and the ferritic phase of the internal layer left below is particularly uneven. Depending on the degree of austenitizing, the austenitized surface layers on the opposite sides of the work piece may meet internally. In this case a uniform ferrite layer cannot be maintained and the internal ferrite phase layer may not be contiguous.

While separation of the internal ferrite phase layer does not affect the surface properties of the case member component, it does affect performance as a magnetic shield. More simply, the resulting part is unsuitable for use as a magnetic shield.

SUMMARY

By using a housing that can be easily processed, provides the hardness, corrosion resistance, appearance, and other surface characteristics required for a case member component, and functions sufficiently as a magnetic shield for magnetically shielded components such as a timepiece movement, the invention eliminates the need for a dedicated magnetic shield member in a timepiece or other device, thereby enabling easily reducing product size, while also affording excellent freedom of product design.

A first aspect of the invention is a device having a magnetically shielded component that is magnetically shielded from an external magnetic field, and a housing. The housing is made from a ferritic stainless steel that has an austenitized surface layer rendered on the surface, and an internal layer portion having an internal ferrite phase that functions as a magnetic shield for the magnetically shielded component.

The device housing in this aspect of the invention is easy to process and work because it is made of ferritic stainless steel, while the austenitized surface layer formed on the housing surface provides the hardness, corrosion resistance, appearance, and other surface properties required for a decorative external part. The housing also has an internal ferrite phase rendering an internal layer portion that functions effectively as a magnetic shield for the magnetically shielded component. As a result, the housing functions sufficiently as magnetic shield protecting a timepiece movement or other internal component requiring magnetic shielding. The housing of the invention thus increases the freedom of design for products incorporating the device, while also enabling easily reducing device size by rendering a dedicated magnetic shield unnecessary.

In another aspect of the invention the internal layer portion has an internal base layer of a uniform thickness not including the interfacial area between the internal layer portion and the austenitized surface layer.

As described above, the austenitizing process using nitrogen gas enables nitrogen atoms to penetrate the ferrite phase from both front and back sides of the workpiece being processed, and change the portion where the nitrogen concentration reaches a predetermined level to austenitic phase. The speed at which the nitrogen penetrates the ferrite phase is not uniform and varies by location. As a result, the nitrogen concentration is also not uniform and the boundary between the austenitized surface layer portion and the ferrite phase internal layer portion is particularly uneven. Depending on the degree of austenitizing, the austenitized surface layers on the opposite sides of the work piece may meet internally. In this case a uniform ferrite layer cannot be maintained and the internal ferrite phase layer may not be contiguous. Performance as a magnetic shield drops when this internal ferrite phase layer is not contiguous.

With the present invention, however, the internal layer portion has an internal base layer that has a uniform thickness between the interfacial areas where the internal layer portion meets the austenitized surface layer. In addition to the effect of the first aspect of the invention described above, this aspect of the invention also prevents the problems that arise from discontinuities in the ferrite phase, and thus reliably imparts a magnetic shielding function. This internal base layer of a uniform thickness can be assured by controlling the depth to which the austenitizing process proceeds based on the thickness of the ferritic stainless steel base material.

In another aspect of the invention the device is a timepiece, the magnetically shielded component is a movement inside the timepiece, and the housing is a case member of the timepiece and/or a back cover disposed opposite the movement.

With this aspect of the invention the movement inside a timepiece is covered by the case member and back cover as the housing having a magnetic shielding function, thereby effectively reducing the effects of external magnetic fields in addition to the effects afforded by the first and second aspects of the invention described above. More particularly, because the ferrite phase (inside layer) of the back cover located opposite the movement functions as a magnetic shield, the dedicated magnetic shield that is required by the related art is not needed, and the overall size of the timepiece can therefore be easily reduced. More particularly, because the movement is a dense assembly of precision mechanical parts, the ability to further reduce the size of the movement itself is already near the practical limit. By eliminating the need for a dedicated magnetic shield, however, this aspect of the invention is an effective means of reducing the size of the timepiece.

In another aspect of the invention a bottom plate located between the timepiece dial and the movement is made from a magnetic shield material.

The timepiece dial is covered by a transparent member (such as glass) and cannot be covered by an opaque housing. However, by disposing a bottom plate made from a magnetic shielding material between the timepiece dial and the movement, this aspect of the invention complements the effect of third aspect of the invention described above by reducing the effect of an external magnetic field on the dial side of the timepiece.

In another aspect of the invention the housing is made from a Fe—Cr ferritic stainless steel base member of 17-25 wt % Cr, and nitrogen atoms are added from the surface of the base member to form an austenitized surface layer while leaving a ferrite phase internal layer portion.

In this aspect of the invention the housing is made from a Fe-Cr ferritic stainless steel base member of 17-25 wt % Cr, and can therefore be easily and reliably rendered with an austenitized surface layer that provides the surface properties (hardness, corrosion resistance, appearance) required in a decorative external component while leaving a ferrite phase with an internal structure that functions as a magnetic shield for the magnetically shielded component.

Further preferably, the Ni content of the base member is less than or equal to 0.05 wt %.

This aspect of the invention effectively prevents reactions caused by metal allergies.

Another aspect of the invention is a method of manufacturing a housing used as an external part of a device, having steps of producing a housing of the desired shape using ferritic stainless steel, converting the surface to single-phase austenite by causing nitrogen atoms to be absorbed from the surface of the housing to austenitize the entire surface and then quenching the housing, and returning an inside portion to a ferrite phase inside layer while leaving an austenitized surface layer at the surface by heating the single-phase austenite and then cooling at a cooling rate that produces chromium nitride.

This manufacturing method enables converting the ferritic stainless steel entirely to single-phase austenite by completing the austenitizing process after adding nitrogen to the concentration required for austenitization. This conversion can be accomplished by repeating the austenitizing process multiple times.

After heating the single-phase austenite and then cooling at a rate that produces chromium nitride, the surface is left as a austenitized surface layer while the inside can be returned to a ferrite phase inside layer. This is because the production of chromium nitride reduces the nitrogen concentration in that part, and the austenite phase at the inside portion where the nitrogen concentration drops becomes unstable changes to ferrite phase. While chromium nitride is also produced in the surface layer area, the nitrogen concentration is higher in the surface layer than inside. As a result, chromium nitride production lowers the nitrogen concentration in the surface layer but the austenite phase remains stable. This method can therefore also be used to manufacture the housing according to the present invention.

This manufacturing method results in chromium nitride being dispersed in both the austenitized surface layer and the internal ferrite phase layer, that is, throughout the housing, and thus increases the overall strength.

Other objects and attainments together with a fuller understanding of the invention will become apparent and appreciated by referring to the following description and claims taken in conjunction with the accompanying drawings.

DESCRIPTION OF PREFERRED EMBODIMENTS

Embodiment 1

Preferred embodiments of the present invention are described below with reference to the accompanying figures.

Figure 1:
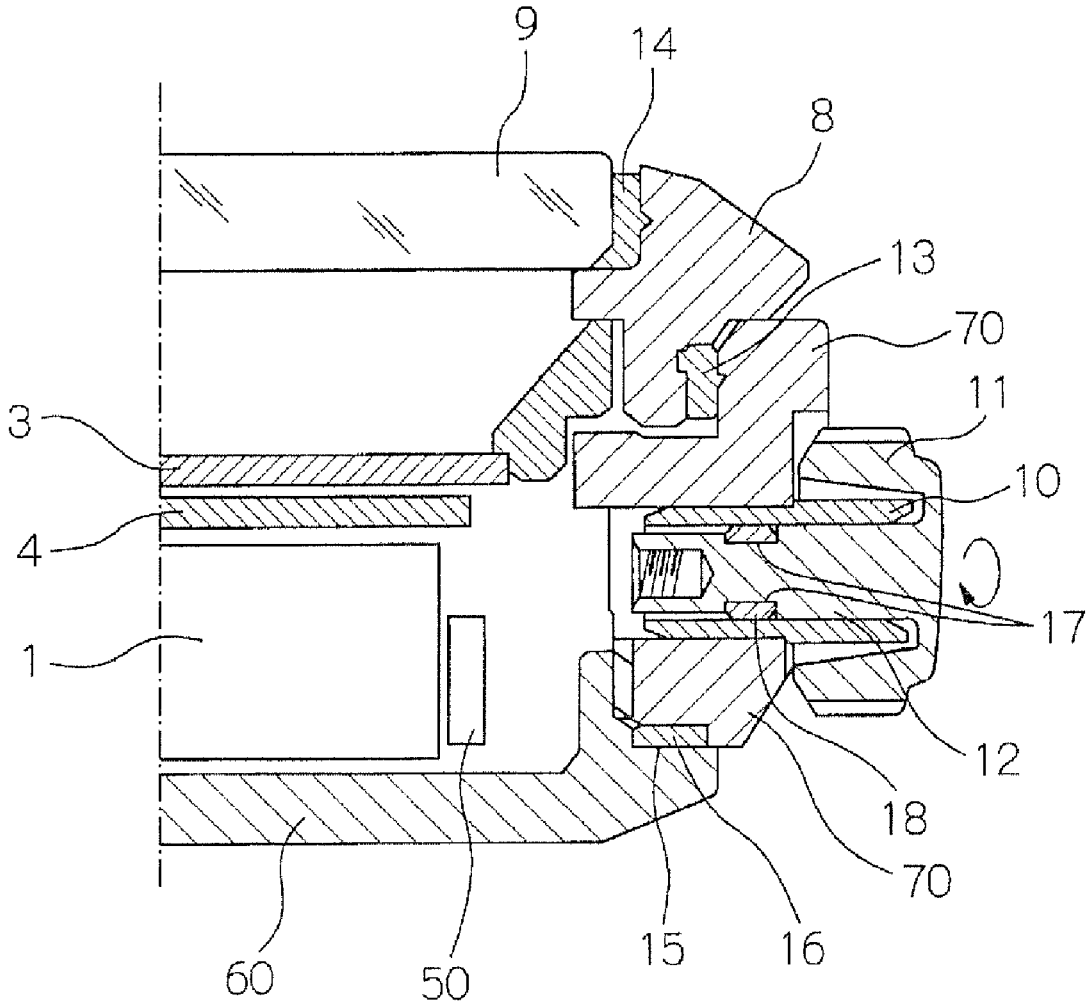
FIG. 1 is a partial schematic section view of a timepiece as an example of a device according to a preferred embodiment of the invention.
Figure 2:
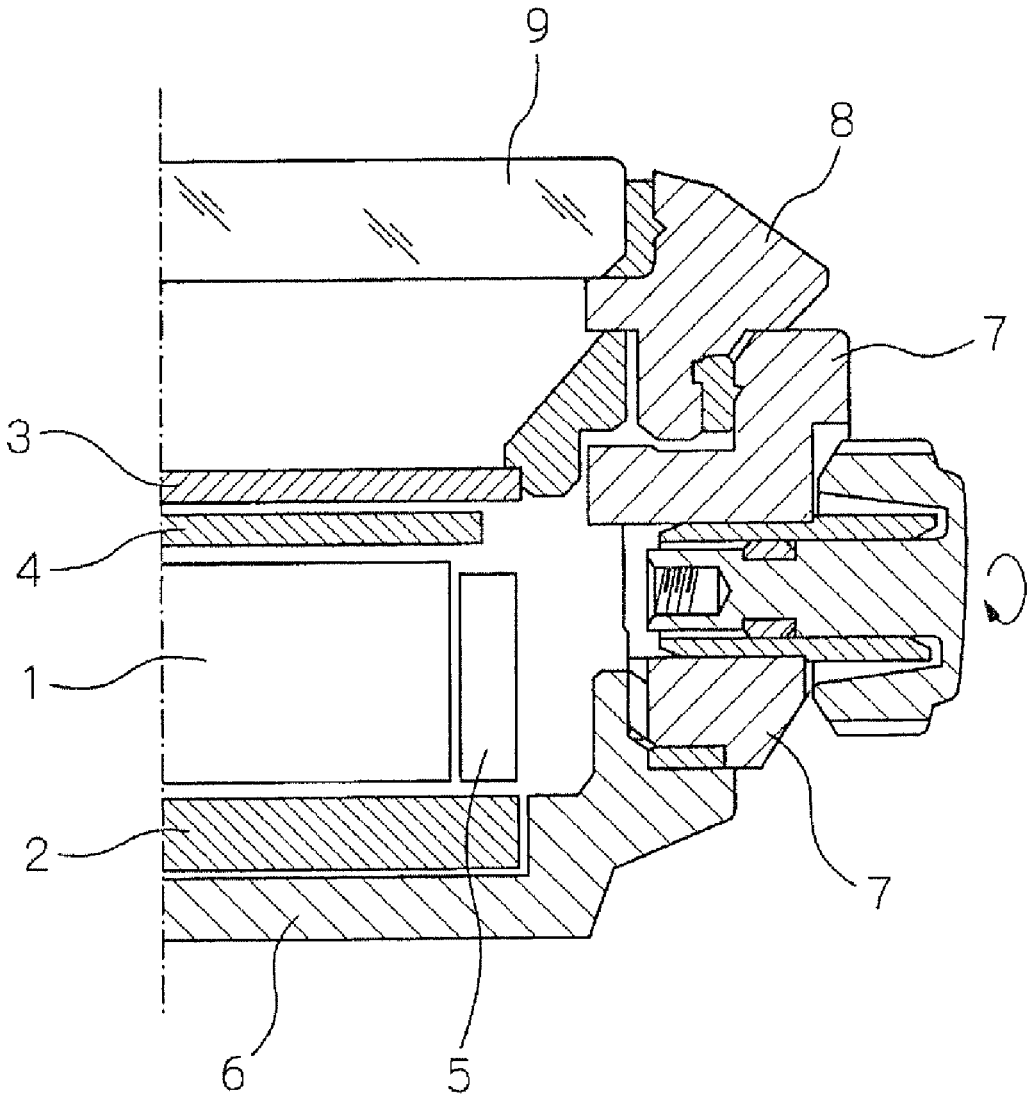
FIG. 2 is a partial schematic section view of a timepiece according to the related art.

FIG. 1 is a partial section view of a timepiece (a portable timepiece such as a wristwatch) as an example of a device according to a preferred embodiment of the invention. FIG. 2 is a partial section view of a timepiece according to the related art.

The structure of the related art is described first below with reference to FIG. 2. As shown in FIG. 2 an inside cover 2 that is a dedicated magnetic shield member made from a magnetic material is disposed below the bottom of the movement 1. A bottom plate 4, which is a magnetic shield, is also disposed between the movement 1 and the dial 3, and a spacer 5 that is yet another magnetic shield is disposed around the sides.

A back cover 6 rendering part of the housing is also part of the case and is disposed covering the inside cover 2 (dedicated magnetic shield). The case member 7, which is also part of the housing, is screwed together with the back cover 6 to cover the spacer 5 from the outside. The back cover 6 and case member 7 rendering the housing are made from a material that provides the hardness, corrosion resistance, appearance, and other surface properties required for the case member of a timepiece. Because dedicated magnetic shields are provided, the back cover 6 and case member 7 do not need to also function as magnetic shields.

The bezel 8 and crystal 9 are also shown in FIG. 2.

The construction of a timepiece according to a preferred embodiment of the invention is described next with reference to FIG. 1. This embodiment of the invention does not have the inside cover 2 that is used in the related art. The back cover 60 is directly opposite the bottom of the movement 1. The case member 70 screws together with the back cover 60.

Figure 3:
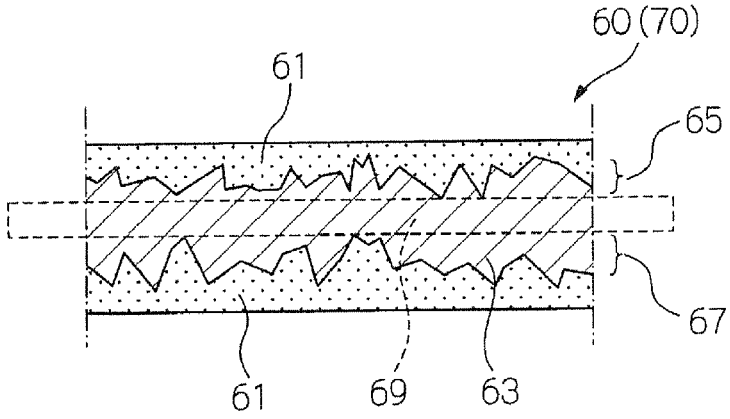
FIG. 3 is a schematic section view describing the cross sectional structure of a housing according to the present invention.

As shown in FIG. 3, the back cover 60 and case member 70 are made from ferritic stainless steel with an austenitized surface layer 61 rendered in the surface. The ferrite phase inside layer portion 63 has an internal structure that functions as a magnetic shield for the movement 1, which is a magnetically shielded component. In this embodiment of the invention the inside layer portion 63 is an internal structure rendering an internal base layer 69 that has a uniform thickness between the rough portions 65 and 67 at the interfaces to the austenitized surface layers 61.

The internal base layer 69 is 50 μm thick in this embodiment of the invention. The thickness of the internal base layer 69 is determined according to the size of the timepiece and the expected strength of the external magnetic field to which the timepiece will be exposed. The thickness is preferably approximately 50 μm, and in a large timepiece may be approximately 1000 μm to 2000 μm depending upon the thickness of the ferritic stainless steel plate.

The back cover 60 and case member 70 are made from an Fe—Cr ferritic stainless steel substrate containing 17-25wt % Cr, and the austenitized surface layer 61 is rendered by adding nitrogen atoms from the surface of the base layer to leave this ferrite phase inside layer portion 63.

The thickness of the austenitized surface layer 61 is set to achieve the hardness, corrosion resistance, appearance, and other surface characteristics required for an external case member. The base surface layer equivalent to the internal base layer 69 is preferably at least 5 μm thick. In a large timepiece, the thickness could be approximately 2000 μm.

Figure 4:
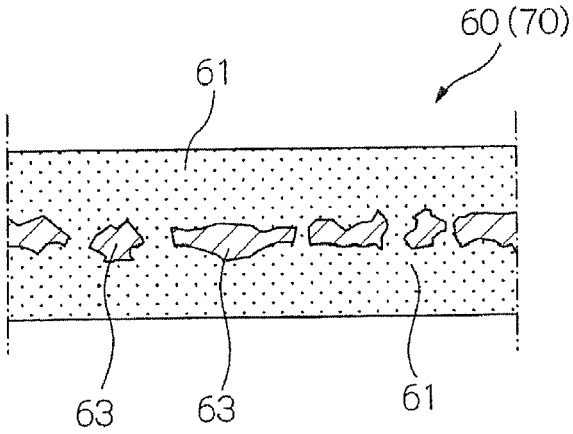
FIG. 4 is a schematic section view describing the cross sectional structure of a housing when the inside layer is not contiguous.

FIG. 4 shows the internal structure when the internal base layer 69 is not present. In this case the austenitizing process proceeded to a depth that rendered the ferrite-phase inside layer portion 63 discontinuous. More specifically, austenitizing continued until the austenitized surface layers 61 rendered from the opposite sides met in the middle such that a ferrite phase layer of uniform thickness could not be sustained and the inside layer portion 63 became non-contiguous. Because the magnetic shield effect is impaired when the inside layer portion 63 is not contiguous, the austenitizing process is preferably controlled to leave at least the internal base layer 69.

Referring again to FIG. 1, unlike in the related art, the spacer 50 in this embodiment of the invention is made from plastic or other nonmagnetic material. This is because the spacer 50 does not need to function as a magnetic shield as a result of the magnetic shielding provided by the back cover 60 and case member 70. Eliminating this magnetic shielding capability means that the size and weight of the spacer 50 can also be commensurately reduced compared with the related art. The bottom plate 4 disposed below the dial 3 is the same as in the related art.

As also shown in FIG. 1, a stem pipe 10 is press fit into the case member 70, and the stem 12 of the crown 11 is rotatably inserted through the stem pipe 10. The bezel 8 is affixed to the case member 70 with plastic packing 13, and the crystal 9 is attached to the bezel 8 with plastic packing 14.

The back cover 60 is screwed to the case member 70, and annular rubber packing (back cover packing) 16 intercedes at the seal portion 15 between the back cover 60 and case member 70. This seal portion 15 renders a fluid-tight seal that provides water resistance.

A channel 17 is formed around the outside of the middle part of the stem 12 of the crown 11. Annular rubber packing (crown packing) 18 is fit inside this channel 17. This rubber packing 18 fits tightly against the inside surface of the stem pipe 10, and is compressed between this inside surface and the inside surfaces of the channel 17. This structure renders a fluid-tight seal that provides water resistance. When the crown 11 is turned, the rubber packing 18 rotates with the stem 12 and slides in the circumferential direction against the inside surface of the stem pipe 10.

The operation of the embodiment described above is described next.

The back cover 60 and case member 70 rendering the timepiece housing in this embodiment of the invention are made of ferritic stainless steel, and are therefore easy to work and process while the austenitized surface layer 61 rendered on the surfaces provide the hardness, corrosion resistance, appearance, and other surface properties required for an external case member component.

The internal ferrite phase inside layer portion 63 renders an internal structure that provides sufficient magnetic shielding for the movement 1, and thus functions sufficiently as a magnetic shield for the movement 1. Excellent freedom of design is thus achieved for designing timepiece products, while eliminating the need for the dedicated magnetic shields 2 and 5 required in the related art enables easily reducing device size.

Achieving a smaller device size is described more specifically next. Because the inside (ferrite phase) layer portion 63 of the back cover 60 that is disposed directly opposite the timepiece movement 1 functions as a magnetic shield, the dedicated magnetic shield 2 that is conventionally required is rendered unnecessary, and the overall size of the timepiece can therefore be easily reduced. More particularly, because the movement 1 is a dense assembly of precision mechanical parts and the ability to further reduce the size of the movement itself is therefore already near the practical limit, eliminating the need for a dedicated magnetic shield 2 is an effective means of reducing the size of the timepiece.

In addition, because the internal structure of the back cover 60 and case member 70 has an internal base layer 69 of uniform thickness between the roughness portions 65 and 67 at the interface between the inside layer portion 63 and the austenitized surface layer 61, the problems caused by discontinuities in the inside layer portion 63 as shown in FIG. 4 are prevented, and a magnetic shield effect can be reliably achieved. This internal base layer 69 of a uniform thickness can be assured by controlling the depth of the austenitizing process based on the thickness of the ferritic stainless steel base layer.

In the embodiment described above both the back cover 60 and case member 70 of the timepiece have the hardness, corrosion resistance, appearance, and other surface characteristics required for an external case member component while also being manufactured from a material that provides a magnetic shield effect (that is, ferritic stainless steel with an austenitized surface layer). Depending upon the timepiece design, however, this material could be used either the back cover 60 or case member 70 while the other is made from a different material that only imparts the surface properties desired in an external case member component.

Embodiment 2

In the first embodiment of the invention described above the housing (back cover 60 and case member 70) is rendered with an austenitized surface layer 61 produced by adding nitrogen atoms from the surface of a ferritic stainless steel substrate while leaving a ferrite phase inside layer portion 63. The housing can alternatively be rendered as described below.

Figure 5:
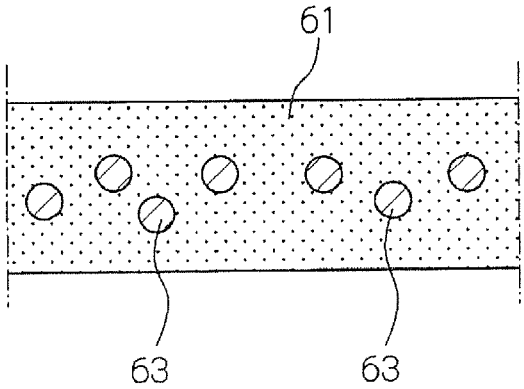
FIG. 5 is a schematic section view describing a method of manufacturing a housing according to another embodiment of the invention.

The housing of the desired shape is first manufactured from ferritic stainless steel. The surface of the housing is then caused to absorb nitrogen atoms until the entire surface is austenitized, and the housing is then rapidly cooled to produce single-phase austenite. After heating, the heated single-phase austenite is then cooled at a rate producing chromium nitride. As shown schematically in FIG. 5, this process leaves an austenitized surface layer 61 while returning the inside part to a ferrite-phase inside layer portion 63. FIG. 5 shows the process at the stage where only a small amount has been returned to ferrite phase from the austenite phase, and the ferrite phase portions are dispersed. As the amount that is returned to ferrite phase increases, the internal structure shown in FIG. 3 can be restored.

This manufacturing method enables converting the ferritic stainless steel entirely to single-phase austenite by completing the austenitizing process after adding nitrogen to the concentration required for austenitization. This conversion can be accomplished by repeating the austenitizing process multiple times.

After heating the single-phase austenite and then cooling at a rate that produces chromium nitride, the surface is left as a austenitized surface layer while the inside can be returned to a ferrite phase inside layer. This is because the production of chromium nitride reduces the nitrogen concentration in that part, and the austenite phase at the inside portion where the nitrogen concentration drops becomes unstable changes to ferrite phase. While chromium nitride is also produced in the surface layer area, the nitrogen concentration is higher in the surface layer than inside. As a result, chromium nitride production lowers the nitrogen concentration in the surface layer but the austenite phase remains stable. This method can therefore also be used to manufacture the housing according to the present invention.

This manufacturing method results in chromium nitride being dispersed in both the austenitized surface layer 61 and the internal ferrite phase inside layer portion 63, that is, throughout the housing, and thus increases the overall strength.

Ferritic Stainless Steel

Ferritic stainless steel, which is the material used to manufacture a housing according to the invention, is described next. The ferritic stainless steel used to manufacture the housing of the invention is a Fe—Cr alloy and is otherwise not specifically limited but preferably meets the conditions described below.

The Fe—Cr alloy used in the housing is preferably 15-25 wt % Cr, and further preferably is 17-22 wt %. A Cr content in these ranges achieves good corrosion resistance, appearance, workability, and magnetic shielding.

If the Cr content is less than the lower limit described above, sufficient corrosion resistance is difficult to achieve.

If the Cr content exceeds the upper limit described above, sufficient magnetic shielding is difficult to achieve and it can be difficult to sufficiently prevent the adverse effects of external magnetic fields on the timepiece movement when the materials is used in a timepiece housing.

The Fe—Cr alloy used in the housing can contain components (elements) other than Fe and Cr. This enables achieving the unique effects afforded by the particular component (element) used. Examples of such components (elements) include Mo, Nb, Mn, Si, Zr, and Ti.

For example, including Mo in the Fe—Cr alloy used in the housing enables the introduction of nitrogen atoms into the near-surface area of the substrate (such as diffusion to the grain boundary) to proceed efficiently while producing the austenitized surface layer 61 described above, and achieves particularly outstanding corrosion resistance for a case member component. The content of Mo in the Fe—Cr alloy substrate is preferably 1.0-4.0 wt %, and yet further preferably is 1.5-3.5 wt %.

If the Mo content is within these ranges, a particularly outstanding appearance is achieved for a case member component, the introduction of nitrogen atoms to the near-surface area of the substrate (such as diffusion to the grain boundary) can be made to proceed efficiently while producing the austenitized surface layer 61, and particularly outstanding corrosion resistance for a case member component can be imparted.

If the Mo content is less than the lower limit described above, sufficient corrosion resistance as a case member component is difficult to achieve depending upon the content of other materials. If the Mo content is less than this lower limit, it is also difficult to sufficiently efficiently advance the introduction of nitrogen atoms to the near-surface area of the substrate (such as diffusion to the grain boundary) while producing the austenitized surface layer 61.

If the Mo content is greater than the upper limit described above, nonuniformity in the composition of the austenitized surface layer 61 becomes severe, deposits of Fe, Cr, and Mc appear, and the attractiveness of the housing as a case member component drops.

Including Nb in the Fe—Cr alloy used in the housing improves the hardness of the austenitized surface layer 61, and achieves particularly outstanding scratch resistance and dent resistance as a case member component. The content of Nb in the Fe—Cr alloy substrate is preferably 0.08-0.28 wt %, and yet further preferably is 0.10-0.25 wt %.

If the Nb content is within these ranges, a particularly outstanding appearance is achieved for a case member component while particularly outstanding durability (scratch resistance and dent resistance) can also be achieved.

If the Nb content is less than the lower limit described above, the foregoing effects of including Nb cannot be achieved.

If the Nb content is greater than the upper limit described above, corrosion resistance as an external case member component drops.

The Fe—Cr alloy used in the housing preferably contains no Ni or the Ni content is sufficiently low. This enables the introduction of nitrogen atoms to the near-surface area of the substrate (such as diffusion to the grain boundary) to proceed efficiently while producing the austenitized surface layer 61, and achieves particularly outstanding corrosion resistance and durability for a case member component. The magnetic shielding performance of the housing is also excellent, and the adverse effects of external magnetic fields on the timepiece movement can be reliably prevented when the housing is used as a timepiece case member. Adverse reactions due to metal allergies can also be more effectively prevented.

The content of Ni in the Fe—Cr alloy used in the housing is preferably less than or equal to 0.05 wt %, and yet further preferably is less than or equal to 0.01 wt %. This makes the effects described above even more pronounced.

The Fe—Cr alloy used in the housing preferably contains no C or the C content is sufficiently low. This more effectively minimizes the drop in corrosion resistance during molding.

The content of C in the Fe—Cr alloy used in the housing is preferably less than or equal to 0.02 wt %, and yet further preferably is less than or equal to 0.01 wt %. This makes the effects described above even more pronounced.

The Fe—Cr alloy used in the housing preferably contains no S or the S content is sufficiently low. This enables achieving particularly outstanding corrosion resistance for an external case member component.

The content of S in the Fe—Cr alloy used in the housing is preferably less than or equal to 0.02 wt %, and yet further preferably is less than or equal to 0.01 wt %. This makes the effects described above even more pronounced.

The Fe—Cr alloy used in the housing preferably contains no P or the P content is sufficiently low. This enables achieving particularly outstanding corrosion resistance for an external case member component.

The content of P in the Fe—Cr alloy used in the housing is preferably less than or equal to 0.07 wt %, and yet further preferably is less than or equal to 0.05 wt %. This makes the effects described above even more pronounced.

An austenitized surface layer 61 is rendered as described above by adding nitrogen atoms near the surface of the substrate.

This austenitized surface layer 61 provides the outstanding hardness, scratch resistance (difficulty being scratched), and dent resistance (difficulty being dented) desirable in an external case member component.

More specifically, by using a primarily Fe—Cr alloy as the substrate in which a austenitized surface layer 61 is formed, a particularly outstanding appearance is achieved together with the outstanding hardness, scratch resistance, dent resistance, and corrosion resistance that are desirable in an external case member component. The resulting external case member component is therefore extremely durable and retains an excellent appearance for a long time.

The content of nitrogen in the austenitized surface layer 61 is preferably 0.3-1.2 wt %, and yet further preferably is 0.8-1.2 wt %.

If the nitrogen content in the austenitized surface layer 61 is within this range, a particularly outstanding appearance and durability for a case member component are achieved.

If the nitrogen content in the austenitized surface layer 61 is less than the lower limit described above, it can be difficult to achieve sufficient hardness and durability (scratch resistance, dent resistance, and corrosion resistance) for use as an external case member component depending upon the thickness of the austenitized surface layer 61.

If the nitrogen content in the austenitized surface layer 61 is greater than the upper limit described above, it can be difficult to control the nitrogen content depending upon the thickness of the austenitized surface layer 61, and either a long time or complex equipment is needed to introduce the nitrogen.

The Vickers hardness Hv of the area where the austenitized surface layer 61 is rendered is preferably 350 or greater, further preferably 400 or greater, and yet further preferably 450 or greater for use as an external case member component. If the Vickers hardness Hv is less than the above lower limit, the scratch resistance will not be sufficient for an external case member component.

Manufacturing the Housing

A method of manufacturing a housing as an external case member component is described next.

Substrate Preparation

The substrate is ferritic stainless steel composed primarily of an Fe—Cr alloy. The substrate is usually preformed to the desired shape of the external case member component being manufactured. Because ferritic stainless steel is generally easy to process, even complicated, detailed housings such as used in the case member of a timepiece can be easily and reliably formed.

Other surface treatment processes, such as polishing, brushing, and satinizing, can be applied to the material used to manufacture the external case member component before the austenitizing process. This enables imparting variation to the surface luster of the final case member, and enables further improving the decorativeness of the final case member component. Polishing can be done using various methods known from the literature, including buffing, barrel polishing, and other types of mechanical polishing methods.

Austenitizing Process

An austenitizing process is then applied to the ferritic stainless steel substrate. This process renders an austenitized surface layer 61 near the surface of the substrate, and leaves a ferrite phase inside layer portion 63 between the austenitized surface layers 61 as described above (see FIG. 3).

The austenitizing process is not limited to any specific method, but preferably involves a heat treatment process in a nitrogen atmosphere followed by a quenching process that rapidly cools the workpiece. This prevents such problems as surface roughening, and enables efficiently forming the austenitized surface layer 61.

The heat treatment process used here preferably increases the temperature of the space in which the workpiece is placed at a predetermined rate and then holds the space at a predetermined temperature (sustained temperature) T.

The temperature increase of the heat treatment process is not specifically limited, but is preferably 5-2° C./minute, and further preferably is 5-15° C./minute.

If the heating rate of the heat treatment process is within these limits, enlargement of the substrate can be effectively prevented.

If the heating rate is less than the lower limit, the heat treatment process takes more time, the workpiece easily expands, and the production cost of the external case member component tends to increase.

If the heating rate exceeds the upper limit of this range, the load on the heat treatment equipment increases.

The sustained temperature T of the heat treatment process is not specifically limited, but is preferably 950-1300° C. and is further preferably 1000-1200° C.

If the sustained temperature is within this range, problems such as substrate deformation and surface roughening can be sufficiently prevented, and a desirable austenitized surface layer 61 can be efficiently created.

If the sustained temperature is below the lower limit of this range, austenitization of the substrate does not proceed sufficiently.

If the sustained temperature is above the upper limit of this range, it is difficult to sufficiently prevent problems such as substrate deformation and surface roughening, and a drop in appearance that is undesirable for a case member component typically occurs.

Note that the sustained temperature can vary within the above predetermined temperature ranges. In this case both the maximum and minimum sustained temperatures T are within the above ranges.

The holding time that the substrate is held to a temperature of 950° C. or above in the heat treatment process is preferably 3-48 hours, and further preferably is 10-30 hours.

If the holding time is within this range, problems such as substrate deformation and surface roughening can be sufficiently prevented, and a desirable austenitized surface layer 61 can be efficiently created.

If the holding time is below the lower limit of this range, austenitization of the substrate does not proceed sufficiently.

If the holding time is above the upper limit of this range, it is difficult to sufficiently prevent problems such as substrate deformation and surface roughening, and a drop in appearance that is undesirable for a case member component typically occurs. The productivity of the housing production process also drops if the holding time exceeds this upper limit.

The cooling rate of the quenching process (such as the time required to lower the temperature of the substrate from the sustained temperature T to 100° C.) is not specifically limited, but is preferably greater than or equal to 80° C./second and yet further preferably 100-300° C./second. This enables achieving particularly high hardness and a more uniform austenitized surface layer 61, and achieves a particularly outstanding appearance and durability for an external case member component.

If the cooling rate is below this lower limit, the Cr in the substrate may unintentionally react with the nitrogen during the cooling process, and corrosion resistance may drop.

The housing used as an example of an external component is described above as being manufactured from a substrate that has an inside layer portion 63 and an austenitized surface layer 61, but the housing of the invention can have elements other than the substrate. For example, a coating of at least one layer known from the literature can be formed on the surface of the austenitized surface layer 61. This enables further enhancing properties that are desirable for an external case member component, including corrosion resistance, weather resistance, water resistance, oil resistance, scratch resistance, dent resistance, wear resistance, discoloration resistance, rust resistance, soiling resistance, and clouding resistance.

A decorative article according to the present invention is also not limited to items manufactured by the method described above.

Specific examples of housings according to the present invention are described next.

1. Housing Manufacture

EXAMPLE 1

A housing component, specifically the back cover of a timepiece, was manufactured using the method described below.

A ferritic stainless steel substrate made from an Fe—Cr alloy of primarily Fe was prepared. The composition of this substrate was Fe, 18.3 wt % Cr, 2.25 wt % Mo, 0.15 wt % Nb, 0.26 wt % Mn, 0.006 wt % C, 0.001 wt % S, 0.022 wt % P, 0.21 wt % Si, and was primarily ferrite phase. The content of any element also contained as an unavoidable impurity was less than 0.001 wt %.

This substrate was then forged to produce a substrate with the desired shape of the back cover for a wristwatch, and was then ground and polished as needed.

The substrate was then washed. The substrate was first washed by alkaline electrolytic degreasing for 30 seconds followed by alkaline immersion degreasing for 30 seconds. The substrate was then neutralized for 10 seconds, washed in water for 10 seconds, and then washed in demineralized water for 10 seconds.

An austenitizing process was then applied to form an austenitized surface layer on the surface of the washed substrate and acquire a back cover for a wristwatch.

The austenitizing process is described next.

An austenitizing system that has a work chamber insulated with graphite fiber or other heat insulation, a heating means for heating the inside of the work chamber, a depressurizing means for lowering the pressure (venting) inside the work chamber, and a nitrogen introduction means for introducing nitrogen gas to the work chamber was prepared.

The substrate (workpiece) was then placed inside the work chamber of the austenitizing furnace, and the pressure inside the work chamber was then lowered by the depressurizing means to 2 Pa.

While the depressurizing means continued to vent the work chamber, the nitrogen introduction means introduced nitrogen gas to the work chamber at the rate of 2 liters/minute, and the pressure inside the work chamber was held at 0.08-0.12 MPa. The heating means then increased the temperature inside the work chamber at the rate of 5° C./minute to 1200° C.

After holding the temperature inside the work chamber at 1200° C. for 12 hours, the substrate was quenched with water to 30° C. The quenching speed for cooling the substrate from 1200° C. to 30° C. was an average 150° C./second.

This process introduced nitrogen atoms near the surface of the substrate, and produced a back cover 60 for a wristwatch with an austenitized surface layer 61. The thickness of the resulting austenitized surface layer 61 was 350 μm. The nitrogen content of the austenitized surface layer 61 was 0.9 wt %.

EXAMPLES 2 to 7

Examples 2 to 7 differed from the first example described above only in the composition of the Fe—Cr alloy ferritic stainless steel used for the substrate and the conditions of the austenitizing process as shown in Table 1. Other than these differences, back covers for a wristwatch were manufactured in the same way as described in example 1 above.

Comparison 1

Other than not applying the austenitizing process, the back cover for a wristwatch according to this first comparison sample was manufactured in the same way as the first example described above. More specifically, the back cover resulting from the forging process was used as the back cover of the wristwatch.

Comparison 2

The back cover of a wristwatch was manufactured by the process described below.

A ferritic stainless steel metal powder (primarily Fe with a composition of Fe, 21.63 wt % Cr, 2.28 wt % Mo, 0.12 wt % Nb, 0.06 wt % S, 0.45 wt % Mn, 0.8 wt % Si, 0.018 wt % P, 0.04 wt % C) was prepared. The average particle diameter of the metal powder was 10 μm.

A mixture of this metal powder (75 vol %), polyethylene (8 vol %), polypropylene (7 volt), and paraffin wax (10 vol %) was then kneaded using a kneader. The temperature of the material while kneading was 60° C.

The kneaded material was then pulverized and graded to produce pellets with a 3 mm average particle diameter. The pellets were then used to produce green bodies with the shape of the back cover of the wristwatch by metal injection molding (MIM) using an injection molding machine. The green bodies were molded to allow for contraction from debinding and sintering. The injection molding conditions were a mold temperature of 40° C., 80 kgf/cm$^2$ injection pressure, 20 second mold time, and 40 second cooling period.

The molding was then debinded in a degreasing oven to acquire a brown body. This debinding process held the workpiece in an argon gas atmosphere at $1.0\times10^{-1}$ Pa at 80° C. for 1 hour, and then increased the temperature at a rate of 10° C./hour to 400° C. The sample was weighed during the heating process, and the debinding process ended when weight loss stopped.

The resulting brown body was then sintered in a sintering oven to get the substrate. The sample was sintered in an argon gas atmosphere at $1.3\times10^{-3}$ to $1.3\times10^{-4}$ Pa for 6 hours at 900-1100° C.

The resulting substrate was then cut and polished as needed to acquire a back cover for a wristwatch.

Comparison 3

The back cover of a wristwatch was manufactured by the process described below.

A ferritic stainless steel metal powder (primarily Fe with a composition of Fe, 18 wt % Cr, 2.5 wt % Mo, 0.03 wt % S, 2 wt % Mn, 0.8 wt % Si, 0.04 wt % P, 0.03 wt % C, 15 wt % Ni) was prepared. The average particle diameter of the metal powder was 10 μm.

A mixture of this metal powder (75 vol %), polyethylene (8 vol %), polypropylene (7 vol %), and paraffin wax (10 vol %) was then kneaded using a kneader. The temperature of the material while kneading was 60° C.

The kneaded material was then pulverized and graded to produce pellets with a 3 mm average particle diameter. The pellets were then used to produce green bodies with the shape of a wristwatch case (back cover) by metal injection molding (MIM) using an injection molding machine. The green bodies were molded to allow for contraction from debinding and sintering. The injection molding conditions were a mold temperature of 40° C., 80 kgf/cm$^2$ injection pressure, 20 second mold time, and 40 second cooling period.

The molding was then debinded in a degreasing oven to acquire a brown body. This debinding process held the workpiece in an argon gas atmosphere at $1.0\times10^{-1}$ Pa at 80° C. for 1 hour, and then increased the temperature at a rate of 10° C./hour to 400° C. The sample was weighed during the heating process, and the debinding process ended when weight loss stopped.

The resulting brown body was then sintered in a sintering oven to get the substrate. The sample was sintered in an argon gas atmosphere at $1.3\times10^{-3}$ to $1.3\times10^{-4}$ Pa for 6 hours at 900-1100° C.

The resulting substrate was then cut and polished as needed to acquire a back cover for a wristwatch.

The composition of the material, the conditions of the austenitizing process, and the conditions of the austenitized surface layer are summarized in Table 1 for each of the examples and comparison samples described above.

TABLE 1

| | Content (wt %) | | | | | | | | | Austenitizing conditions | | | | Austenitized layer | |
|---|---|---|---|---|---|---|---|---|---|---|---|---|---|---|---|
| | | | | | | | | | | Heating | Sustained temp. | Time >1000° C. | Cooling | Thickness | Ni content |
| | Cr | Mo | Nb | Mn | C | S | P | Si | Ni | (° C./min) | (° C.) | (hrs) | (° C./sec) | (μm) | (wt %) |
| Ex. 1 | 18.3 | 2.25 | 0.15 | 0.26 | 0.006 | 0.001 | 0.022 | 0.21 | 0.01 | 5 | 1200 | 12 | 150 | 350 | 0.9 |
| Ex. 2 | 25 | 2 | 0.15 | 0.2 | 0.006 | 0.001 | 0.022 | 0.21 | 0.05 | 5 | 1200 | 12 | 150 | 350 | 1.2 |
| Ex. 3 | 17 | 2 | 0.15 | 0.2 | 0.006 | 0.001 | 0.022 | 0.21 | 0.01 | 5 | 1200 | 12 | 150 | 350 | 0.9 |
| Ex. 4 | 18 | 1 | 0.15 | 0.2 | 0.006 | 0.001 | 0.022 | 0.21 | 0.01 | 10 | 1100 | 4 | 30 | 100 | 0.9 |
| Ex. 5 | 19 | 3 | 0.15 | 0.2 | 0.006 | 0.001 | 0.022 | 0.21 | 0.01 | 8 | 1250 | 30 | 120 | 500 | 0.9 |
| Ex. 6 | 18.3 | 2.25 | 0.15 | 0.26 | 0.006 | 0.001 | 0.022 | 0.21 | 0.01 | 5 | 1200 | 0.5 | 150 | 5 | 0.9 |
| Ex. 7 | 17 | 2 | 0.1 | 0.2 | 0.006 | 0.001 | 0.022 | 0.21 | 0.01 | 5 | 1200 | 12 | 150 | 350 | 0.3 |
| Comp. 1 | 18.5 | 2.25 | 0.15 | 0.26 | 0.006 | 0.001 | 0.022 | 0.21 | 0.01 | | | | | | |
| Comp. 2 | 21.63 | 2.28 | 0.12 | 0.45 | 0.04 | 0.06 | 0.018 | 0.8 | 0.01 | | | | | | |
| Comp. 3 | 18 | 2.5 | | 2 | 0.03 | 0.03 | 0.04 | 0.8 | 15 | | | | | | |

2. Visual Evaluation of Appearance

The back covers for a wristwatch manufactured in each of the above examples and comparison samples were visually and microscopically inspected and then ranked according to the following four levels.

VG: very good appearance

G: good appearance

OK: acceptable appearance

X: unacceptable appearance

3. Surface Layer Scratch Resistance

The scratch resistance of each of the back covers manufactured in the examples and comparison samples described above was evaluated using the following test method.

The surface of each sample was brushed back and forth 50 times using a brass bristle brush pressed against the surface with a load of 0.2 kgf.

The surface of the back cover was then visually inspected and the appearance was ranked according to the following four levels.

VG: no observable surface scratches

G: substantially no observable surface scratches

OK: slight surface scratching observable x: significant surface scratching observable 4. Dent Resistance The dent resistance of each of the back covers manufactured in the examples and comparison samples described above was evaluated using the following test method.

A stainless steel ball (1 cm diameter) was dropped from a height of 50 cm above the back cover, the size (diameter) of the indentation left in the surface of the back cover was measured, and the results were ranked according to the following four levels.

VG: dent diameter<1 mm or no observable dents

G: 1 mm<=dent diameter<2 mm

OK: 2 mm<=dent diameter<3 mm x: dent diameter>=3 mm

5. Corrosion Resistance

The corrosion resistance of each of the back covers manufactured in the examples and comparison samples described above was evaluated by measuring the pitting potential according to the method described in JIS G 0577. The higher the pitting potential, the greater the corrosion resistance.

6. Magnetic Shielding (Magnetic Resistance)

The magnetic shielding (magnetic resistance) of each of the back covers manufactured in the examples and comparison samples described above was evaluated using the following test method.

Each of the back covers manufactured in the examples and comparison samples described above was punched in the middle through the thickness of the sample to remove a blank. The blank was then ground at 30° C. and loaded into a gelatin capsule. The magnetization of each capsule was then measured using a magnetometer (MPMS-5S SQUID, Quantum Design) to get a hysteresis curve. Magnetization was measured at 37° C. in a magnetic field ranging from −1000 G to 1000 G (approximately −80,000 m/A to 80,000 m/A). The slope of the hysteresis curve near a field strength of 0 was measured to determine permeability. Magnetic shielding improves as permeability rises.

The results of these measurements are shown in Table 2 together with Vickers hardness Hv measurements. The Vickers hardness Hv measurements indicate the results using a 20 gf measurement load at the surface of each sample (where the austenite surface layer was formed on each sample).

TABLE 2

| | Appearance | Scratch resistance | Dent resistance | Corrosion resistance | Magnetic shielding |
|---|---|---|---|---|---|
| Example 1 | VG | VG | VG | VG | VG |
| Example 2 | VG | VG | VG | VG | G |
| Example 3 | VG | VG | VG | G | VG |
| Example 4 | VG | VG | G | G | VG |
| Example 5 | G | VG | VG | VG | G |
| Example 6 | VG | G | G | G | VG |
| Example 7 | VG | G | G | G | VG |
| Comparison 1 | G | X | X | X | G |
| Comparison 2 | X | VG | VG | X | G |
| Comparison 3 | X | VG | VG | X | X |

As will be known from Table 2 each of the back covers according to the present invention offers an excellent appearance as well as excellent scratch resistance, dent resistance, and corrosion resistance. As a result, a back cover according to the present invention can retain its particularly attractive appearance for a long period of time.

The back cover of the invention also offers excellent magnetic shielding. The back cover of the invention also offers an outstanding texture with no surface roughness.

In contrast, the back covers in each of the comparison samples did not provide satisfactory results.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A device comprising:

a magnetically shielded component that is magnetically shielded from an external magnetic field; and a housing, the housing being made from a ferritic stainless steel that has an austenitized surface layer rendered on a surface, and an internal layer portion having an internal ferrite phase that functions as a magnetic shield for the magnetically shielded component, the device being a timepiece with a rotor, the magnetically shielded component being a movement inside the timepiece, the housing being a case member of the timepiece and/or a back cover disposed opposite the movement.

2. The device described in claim 1, wherein:

the internal layer portion has an internal base layer of a uniform thickness not including the interfacial area between the internal layer portion and the austenitized surface layer.

3. The device described in claim 1, wherein a bottom plate located between the timepiece dial and the movement is made from a magnetic shield material.

4. The device described in claim 1, wherein:

the housing is made from a Fe—Cr ferritic stainless steel base member of 17-25 wt% Cr, and nitrogen atoms are added from the surface of the base member to form an austenitized surface layer while leaving a ferrite phase internal layer portion.

5. The device described in claim 4, wherein:

the Ni content of the base member is less than or equal to 0.05 wt%.

6. A method of manufacturing a housing used as an external part of a device, comprising steps of:

producing a housing of the desired shape using ferritic stainless steel;

converting the surface to single-phase austenite by causing nitrogen atoms to be absorbed from the surface of the housing to austenitize the entire surface and then quenching the housing; and returning an inside portion to a ferrite phase inside layer while leaving an austenitized surface layer at the surface by heating the single-phase austenite and then cooling at a cooling rate that produces chromium nitride, the device being a timepiece with a rotor, the magnetically shielded component being a movement inside the timepiece, the housing being a case member of the timepiece and/or a back cover disposed opposite the movement.

* * * * *